United States Patent [19]

Tian

[11] Patent Number: 4,726,711

[45] Date of Patent: Feb. 23, 1988

[54] PROCESS AND APPARATUS TO FORM AN UNDERGROUND PASSAGE OR SPACE

[76] Inventor: Shanda Tian, No. 68, Lane 740, Yan'an Zhong Lu, Shanghai, China

[21] Appl. No.: 845,082

[22] Filed: Mar. 27, 1986

[30] Foreign Application Priority Data

Apr. 1, 1985 [CN] China ..... 85102785

[51] Int. Cl.[4] ..... E21B 4/00

[52] U.S. Cl. ..... 405/184; 175/19; 405/154

[58] Field of Search ..... 405/138, 184; 175/19, 175/20, 55, 56, 61, 62, 323

[56] References Cited

U.S. PATENT DOCUMENTS

| | | | |
|---|---|---|---|
| 3,132,701 | 5/1964 | Juntunen | 405/184 |
| 3,326,008 | 6/1967 | Baran et al. | 405/184 |
| 3,543,377 | 12/1970 | Bremner | 405/154 |
| 3,630,295 | 12/1971 | Coyne et al. | 405/184 |
| 3,651,650 | 3/1972 | Weiss et al. | 405/184 |
| 4,074,780 | 2/1978 | Gilbert | 175/323 |
| 4,146,347 | 3/1979 | Woods | 405/184 |
| 4,230,191 | 10/1980 | Svirschevsky et al. | 175/20 |
| 4,403,890 | 9/1983 | Miyanagi et al. | 405/184 |
| 4,618,007 | 10/1986 | Kayes | 175/19 |
| 4,624,605 | 11/1986 | Akesaka | 405/184 |

OTHER PUBLICATIONS

E. D. Mikrashevsky and H. Marigunoff, "Vibration Construction Machinery", 1964, pp. 122–123.

China Industrial Publication Co., "Piling Project", 1962, pp. 64 through 66.

Chinese journal, "Aviation Knowledge", third issue of 1977, p. 10.

Sun Gun-Sen and Zhen Da-Tong, "Soft Foundation and Underground Project", Sep. 1984, pp. 630 through 631.

Gan Dor-Chen, "Piling", 1959, pp. 12 through 13.

*Primary Examiner*—Dennis L. Taylor

*Attorney, Agent, or Firm*—Pennie & Edmonds

[57] ABSTRACT

The invention is in an apparatus of self propelled type for forming an underground passage or space as the apparatus moves horizontally, vertically or in some other direction relative to the surface of the ground. The apparatus includes a head for reducing resistance of the soil through which it moves and for squeezing the soil in a desired direction as the head is caused to undergo multimode vibration. The apparatus also includes a thrust producing means for developing forward thrust and a connection for connecting the head and thrust producing means.

20 Claims, 11 Drawing Figures

PROCESS AND APPARATUS TO FORM AN UNDERGROUND PASSAGE OR SPACE

FIELD OF THE INVENTION

The present invention relates to a process for forming an underground passage or space and a vehicle or apparatus for use in the process within a subterranean environment. In particular, the invention relates to a process carried out by means of the vibratory squeezing of the soil, and the apparatus for carrying out the process.

BACKGROUND OF THE INVENTION

In the prior art, in order to proceed with a seismic test in geological prospecting it is necessary to drill a shaft to a certain depth and place a certain amount of explosive within the shaft. Also, in the construction of a highrise building or wharf in a harbor, or in erecting heavy chemical equipment, it is necessary to hammer load bearing piles into the earth to provide a foundation. In such engineering work, apparatus such as an earth boring auger, a vibratory pile driving machine, pile hammer, pulsating drilling machine and/or a spiral piling machine, may be required. These apparatus can either bore a "shaft" of a predetermined diameter or drive a pile column of some length to a predetermined depth. For example, a spiral pile may be sunk to a depth of over twenty meters.

The spiral pile is a steel pipe pile with a spiral fin or blade at its lower end along the outer surface (FIG. 1), requiring a special machine which comprises a moving portion and a fixed portion to move it into the earth. Two or more electric motors are fitted on the fixed portion. The motors operate through a speed variator system to rotate the moving portion which, in turn, is connected to the top of a spiral pile cylinder. The pile follows rotation of the moving portion as it is screwed down into a depth of earth.

Spiral piles of large cross-sectional area including a steel pipe pile having an outside diameter of 35–40 cm and a spiral fin or blade having an outside diameter which ranges from 1–2.5 m, possibly to 3 m, have been constructed. The permissible bearing load of such piles may reach 500 ton or more depending on soil conditions. A large dimension spiral pile may be rotated at a speed of about 0.5–1 revolution per minute; while a smaller dimension spiral pile may be rotated at a speed of up to about 10 revolutions per minute.

Spiral piles have a closed pile head, that is, the lower end of the spiral pile is closed while being sunk. An advantage of having the lower end of the spiral pile closed is that soil is prevented from filling up the pile cylinder. This simplifies the piling process. For example, in screwing down a spiral pile of 30–40 cm diameter to a depth of 10–12 m, an efficiency of 2–3 piles per shift in certain experimental projects has been attained. The spiral pile is applicable to various kinds of soil containing hard clay and bulky entanglements, although it is not applicable with rock. The process of sinking a spiral pile is usually carried out by a crane including a hoist and pile rotating machine for lifting and inserting the spiral pile. Under many circumstances, a spiral pile is more economical than concrete piles and steel piles driven by a pile hammer. However, it is to be appreciated that powerful machinery is indispensable to carry out the piling operation, and the operation also requires steel pipes to be connected together and rotated with the pile to attain a certain depth. Such machinery is hardly able to carry out a piling process in a substantial horizontal direction.

Therefore, in the prior art, when it is required to lay pipe and cable, or to construct an underground tunnel, or a subway in the horizontal direction, the open excavation or trench method is usually adopted. However, if pipe and cable is to be laid below a building, airfield runway, superhighway, railroad bed, river bed, or in other locations at which it is impossible to excavate from the ground surface, the open excavation or trench method is not applicable. The prior art, therefore, has moved to more effective systems of tunneling for pipe and cable laying. These systems may be characterized as the so-called "shield-driven" and "thrustor-driven" systems, both of which are carried without trenching. Thus it is possible to avoid any wracking of the ground. However, it is sometimes necessary that these systems be carried out by removal of scrap earth from the ground by mechanical means or water jet.

An earthwork machine, capable of laying pipe up to a diameter of about 500 cm without trenching has been developed by the Kiev Water Conservancy Engineering Bureau of the Soviet Union. This earthwork machine has been called a "vibratory bullet". The "vibratory bullet" requires no excavation of soil above the pipe, nor does it require soil to be removed from below the pipe. The shell of the "vibratory bullet" (FIG. 2) is made of steel pipe having two conical caps. An eccentric vibrator is fitted inside the shell. The eccentric vibrator is driven by a 10 kw electric motor for developing a circumferential vibration of 2800 cycles per minute. The eccentric vibrator is comprised of two eccentric discs having a moment of 18 kg.cm. In operation, in boring a horizontal passage, it is first required to drill a 75 mm hole for a traction rope which is passed therethrough and connected to the "vibratory bullet". After the eccentric vibrator is started, the "vibratory bullet" is pulled forward by a hoist or tractor to which the other end of the rope is connected. The actual forward speed of the device, in forming a passage in sandy soil is equal to the tractor speed running in third gear. Operation of the device is described in "The Experience of Mechanization in Water Conservancy Engineering" by N. P. Kutlieshenv, Construction Mechanization No. 3, 1958. It is indicated in the article that the wall of the passage, compacted by the "vibratory bullet", will not slump at the time of the laying pipe. And, the article would appear to imply that vibratory action is applicable in some underground work. However, and as previously indicated, it is required that a horizontal pilot hole of a diameter smaller than the diameter of the passage to be formed be drilled beforehand by conventional methods for passing the traction rope for pulling the "vibratory bullet". This preprocess step may create a technically difficult problem, particularly if the pilot hole is of considerable length. Therefore, the "vibratory bullet" has not yet achieved widespread acceptance.

SUMMARY OF THE INVENTION

The present invention is an improvement over the above-mentioned techniques, and provides a process for moving and forming an underground passage or space, and an apparatus characterized as a "subterranean vehicle" to carry out the process. According to the process, the heretofore required steps of trenching, removing scrap soil and creating, by drilling, a hole for a traction rope to pass through are obviated. A passage or space may be formed solely by making use of the "subterranean vehicle".

The process and the apparatus of the present invention for moving and forming an underground passage in the soil comprises the following steps:

(1) using a vibratory means generating a local vibration to render the soil located in close proximity pressed and fluid-like to lower the resistance exerted by the soil on a vibratory body as the vibratory means moves forward. This vibratory action may act in a circumferential, axial, or horizontal direction or in any compound or resultant direction to achieve a desired effect. As used in the invention "close proximity" is a distance from about several millimeters to hundreds of centimeters from the vibratory means; and (2) utilizing a thrust produced by rotation of a spiral fin or other thrust means, such as an hydraulic force to advance the vibratory means and produce a so-called squeezing action as a result of the vibration. That to say, the squeezing action produced by vibration results in a progressing squeezing process as the vibratory means moves forward in the direction of the passage or space being formed throughout the full length of the same.

As an alternative, the passage or space may be formed by means of a spiral-finned pile head producing necessary thrust, or formed by some other hydraulic device to push a squeezing head forward. The sqeezing head may vibrate or not, as desired.

As may be understood the direction of vibratory motion and thrust may be controlled to orientate movement of the apparatus and the passage formed to a desired direction. For example, a gyrospcope or some other means serving as a three dimension sensor and a microcomputer may be employed to give orders to actuators and automate orientation control to effect consequent actions. In addition, the process of vibration may be controlled so as to limit the depth of soil away from the vibratory means which shall undergo fluidization.

Therefore, by means of vibratory squeezing according to the invention it is possible to advance an apparatus concurrently with the formation of a passage or space in a subterranean layer. Since the direction of motion through the subterranean layer may be controlled, the passage formed may be in a vertical, horizontal or inclined attitude. The process of vibratory squeezing may be repeated to form a passage or space larger than the passage or space first formed by using a more powerful apparatus or vehicle. In this way it is possible to excavate a much larger subterranean space, such as a cellar, or an underground garage, for example. Normally, the process to be repeated is controlled in a sidewise horizontal direction relative to the original passage. Care should be exercised under circumstances that the passage is formed close to the surface of the ground. To this end, the process should be modified to prevent the soil layer from buckling upward. The modified process may be carried out by use of a special-shaped squeezing head, such as a wedge with knife edge (see FIG. 9) located in the vertical plane to squeeze the soil in both a sideways and downward direction. Using such a special-shaped squeezing head and maintaining the squeezing head horizontal, vibration motion should be in the directions both perpendicular downward to the direction of forward motion and parallel to the direction of movement, and the ground surface.

Vibratory motion of the first step of the process of the invention may be provided, for example, by various vibratory means, such as an eccentric, an electromagnetic, an hydraulic or pneumatic device provided each vibratory means is powerful enough to induce necessary amplitude and frequency on the portion of the apparatus to be vibrated. In order that vibratory apparatus move smoothly in the subterranean soil, the following fundamental requirements should be fulfilled:

(a) the vibratory amplitude should not be less than a certain limit;

(b) the vibratory frequency should be higher than the destructive frequency of the soil; and (c) the thrusting force to push the body forward should be sufficient to overcome resistance of the soil encountered at the front end of the body.

As to the vibratory amplitude, when the body sinks under vibration the magnitude of vibratory amplitude should exceed the magnitude of vibratory amplitude as the body begins to sink so that the body will continue to sink. The initial magnitude of vibratory amplitude required depends on factors, such as vibration frequency, property of the soil, and both the bulk and shape of the body. Generally, the lower the vibratory frequency and the larger the cross section of the body, the larger will be the initial sinking amplitude. And, the larger the vibration amplitude required to exceed the initial sinking amplitude, the greater the sinking speed of the body.

When a body vibrates in the soil at some predetermined vibratory frequency and vibratory force the frictional resistance to soil along the surface of the body begins to break down so that the body may move freely.

The second step of the process of the invention may be provided to produce a thrust force by rotation of a spiral fin or blade, or by any other apparatus to push the vibratory body forward and effect vibratory squeezing, soil fluidization and, if necessary, a continuation of the advancing thrusting action. In this way, a passage, or tunnel, or space having a diameter slightly larger than the diameter of the body may be constructed.

The apparatus to produce required thrust according to the invention may be similar to the screwing device of the spiral piles including, however, a built-in prime mover. The screwing device may be fitted on the rear portion of the vibratory body. Thus, as the prime mover rotates the screwing device, axial thrust is developed to advance the vibratory body. Also, as the prime mover rotates the screwing device, axial thrust is developed to advance both the vibratory body and the prime mover itself. Since the apparatus has its own power source, it is not necessary to transmit driving torque by way of extension torque tubes, and it is also possible to obviate the need of a tower or crane. Moreover, since the extension torque tubes are not necesary there is a reduction of frictional force. It is possible to form a passage or space in the horizontal direction by use of the apparatus of the invention, necessitating neither a trenching operation nor handling of scrap soil.

As stated, the apparatus of the invention for carrying out the process comprises a body including a vibratory squeezing means in a front section and a thrusting device to provide thrust in a rear section. A flexible coupling, such as a universal joint or sealed corrugated pipe usually serves as a connecting portion to connect the sections. The connecting portion, if necessary, may be used as a housing for sensors and control devices, such as a gyroscope, microcomputer system and hydraulics, for example. This arrangement is suitable to control the vibratory squeezing means in the front section and to monitor the vibration amplitude, vibratory frequency, and the vibration mode and direction, such as circumferential vibration, up and down vibration, right and left vibration, back and forth vibration, and even vibration in a three-dimensional direction of motion. The control system can be located within any section or connecting portion of the apparatus to control the power thrusting device.

When the thrusting device is of rod or pipe type having a spiral fin or blade, the rotating speed of the spiral fin or blade should be controlled. When the thrusting device is of an hydraulic type, the pressure and stroke of the hydraulics should be controlled. When the thrusting device is of jet propulsion type, such as a rocket the rate of combustion and direction of the propulsion apparatus should be controlled. In this way it is possible to control the speed and direction of motion and the apparatus as a whole.

From the discussion of the process and the apparatus used to form a passage or space in a subterranean layer, it may be appreciated that the invention has incorporated various known techniques, including the vibratory squeezing of the "vibratory bullet" and the screwing or thrusting action of the "spiral pile". Additionally the invention has incorporated within the apparatus a self-contained power unit which enables the apparatus to attain results in forming a passage or space superior to those formed utilizing known techniques. This is to say that the invention necessitates no "outside agency" serving as a hoist or tractor to pull the apparatus through a long passage or space formed with difficulty horizontally and formed with far more difficulty in the vertical direction.

Many significant advantages are realized by the invention. Thus, the vehicle or apparatus of the invention moves forward during the process of vibratory squeezing in a vibratory squeezing mode without accumulation of a large amount of scrap soil and without the requirement to remove it from the passage or space to the ground level. In addition, the invention does not require long steel pipes connected together and thrusted or screwed into the earth. Further, the invention does not require use of heavy steel structures or a crane, and also obviates the tremendous frictional resistance exerted by the soil on the long pipes. Therefore, the process and apparatus of the invention is more economical in operation in the effective production of a passage or space by free movement of the apparatus in the subterranean layer.

BEST MODE FOR CARRYING OUT THE INVENTION

The following is a description of several preferred embodiments of the present invention with respect to drawings attached.

Figure 1:
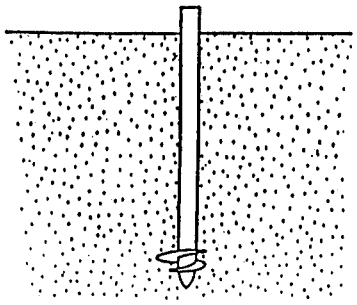
FIG. 1 (PRIOR ART)
FIG. 1 is a schematic diagram of a spiral pile of the prior art.
Figure 2:
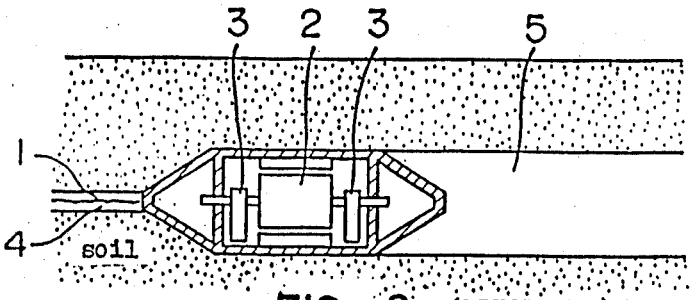
FIG. 2 (PRIOR ART)
FIG. 2 is a schematic diagram of the "vibratory bullet" of the prior art.
Figure 3A:
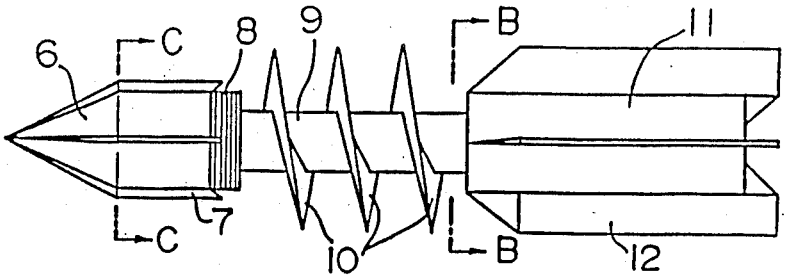
FIG. 3A is a schematic diagram of the spiral thrusting type "subterranean vehicle" comprising a first form of the present invention.
Figure 3C:
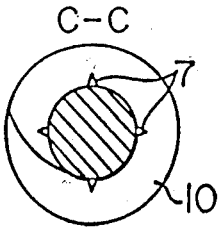
FIG. 3C is a view in section of the construction of FIG. 3A, as seen along the lines C—C.
Figure 3B:
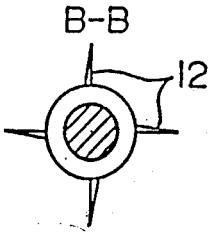
FIG. 3B is a view in section of the construction of FIG. 3A, as seen along the lines B—B.

Referring to FIG. 3 (A, B and C), there is a schematic diagram of a first embodiment of the invention in a spiral thrusting type "subterranean vehicle". The apparatus includes a vibratory squeezing means (6), pipe means (8) of corrugated construction, a thrust rod or pipe (9), a spiral fin or blade (10), a housing (11) of a thrusting device and a stabilizing guide fin or blade (12). The vibratory squeezing means (hereafter "squeezing means") located at the front end of the apparatus is of a construction somewhat similar to that of the "vibratory bullet" as illustrated in FIG. 2. In FIG. 2, the "vibratory bullet" is in a disposition in a passage (5) under construction and connected to a traction rope (1) located in a smaller passage (4) extending in the direction of movement of the "vibratory bullet". FIG. 2 also illustrates a mechanism within the housing of the "vibratory bullet" including a rotor (2) of an electric motor and a pair of eccentric discs (3).

According to the invention, the front end of the squeezing means (6) may be made into different shapes, such as the shape of a pointed cone, semi-spherical ball, or wedge, or the front end may be streamline. The shape will be determined by the soil structure to be traversed. The squeezing means may be fitted with an eccentric of electrically driven type, see FIG. 4, or other type of vibrator device. Squeezing means (6) overall may be made of smooth material or fixed with a set of fins or blades (7) to stabilize it and prevent it from revolving. The fins or blades, also provide a guiding action.

Figure 5:
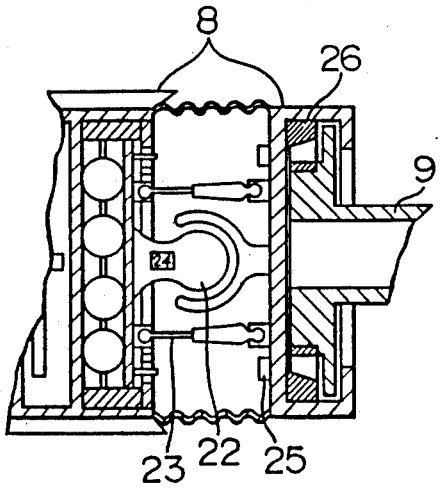
FIG. 5 is a schematic diagram of the cross sectional view of the connection means of the first form of the invention.

Squeezing means (6) is connected with the thrust rod or pipe (9) through the corrugated pipe means or by any thin material structure serving as an enclosed connection means (8), see FIG. 5. A power line may pass through the pipe means (8) to supply electric power to squeezing means (6) and a control system in pipe means (8) under circumstances that a control system is provided and so located.

Figure 4A:
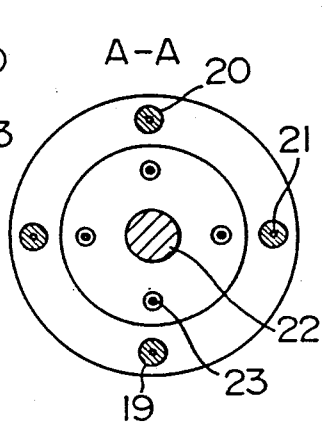
FIG. 4A is a view in section of the construction of FIG. 4, as seen along the lines A—A.
Figure 4:
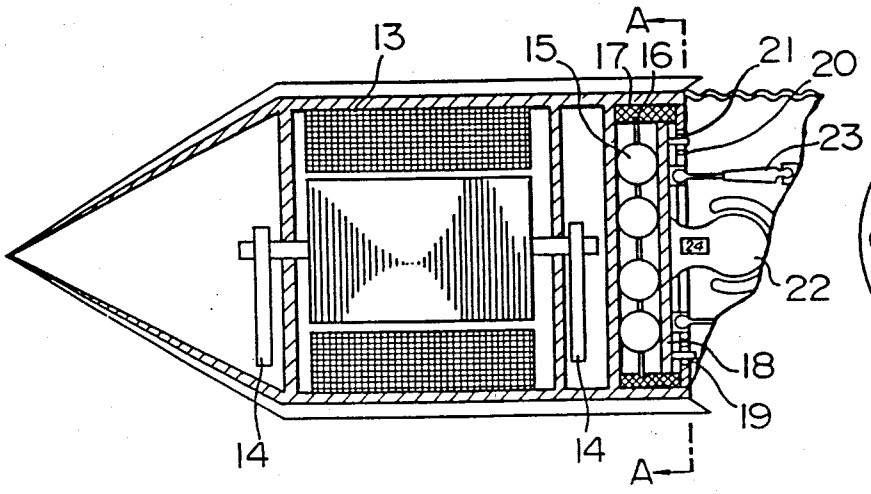
FIG. 4 is a schematic diagram of the cross sectional view of the vibratory squeezing means.

Referring now to FIGS. 4 and 5, an electric motor (13) is located within an inner chamber of squeezing means (6) and, as discussed, the motor drives a pair of eccentrics (14). The eccentrics are also located within the inner chamber toward the front and rear of the squeezing means. A damping mechanism is located in the inner chamber of the squeezing means, as well, but further to the rear of the eccentric. The damping mechanism comprises a plurality of spherical balls (15), ball bracket (16), damping material (17) and (21), see FIG. 4A, bearing plate (18), dowel pin (19) and pin hole (20).

The connection of squeezing means (6), particularly bearing plate (18) of the damping mechanism and thrust rod or pipe (9) within pipe means (8) is completed by a universal joint (22) only generally shown, and an hydraulic device (23). The hydraulic device operates through a control (25) and thrust bearings (26) perhaps best seen in FIG. 5. The universal joint also includes a sensor (24). The bearing plate responds to thrust from a thrusting means or the thrust transmitted through the connection means. Sensor (24) comprises a control means composed of three-dimensional sensors, a microcomputer and actuators, such as a set of hydraulic jacks, to provide three-dimensional control of the squeezing means.

A spiral fin or blade (10) is located along rod or pipe (9) to screw into the soil. It is important that total area of the fin or blade in contact with soil is sufficient to give rise to thrust while moving forward, and to insure that the shear stress or strength and compression strength or pressure against the soil is less than the limits of shear strength and compression strength of the soil. In this way no "slip idling" of the spiral fin or loss of thrust will occur.

Figure 6:
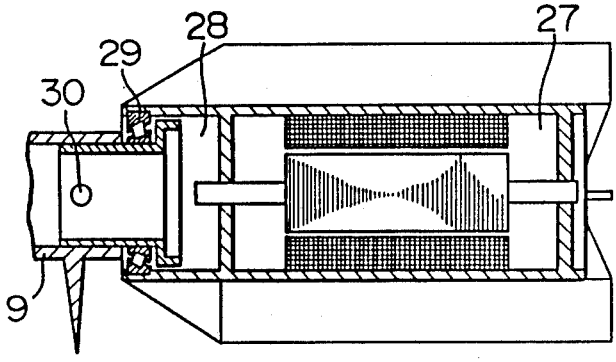
FIG. 6 is a cross sectional view of the connection of a spiral thrust rod or pipe and a prime mover.

With reference to FIG. 6, an electric motor (27) or other types of rotary engine may be connected to thrust rod or pipe (9) as a prime mover of the thrusting means. The connection is through a speed variator (28) supported by bearing (29) for movement relative to the thrust rod or pipe, and pin (30) supported in a pin hole which mechanically connects the rod or pipe and speed variator together. As such, the assembled parts may be disassembled to facilitate transportation of the apparatus. The motor and speed variator may also be connected to the thrust rod or pipe by a universal joint to transmit power to the thrust rod or pipe as well as to rotate the thrust rod or pipe. Rotation of the spiral fin in the soil will drive the vibratory squeezing means (6) and the whole "subterranean vehicle" forward. In order to prevent rotation of housing (11) of the prime mover in the reverse direction when the prime mover is driving the thrust rod or pipe, the apparatus employs a set of stabilizing guide fins (12) fixed to the surface of the housing. A certain portion of the lateral surface of each guide fin will suffice to prevent this reverse rotation. Again, it is important that the shear stress or strength and the compressive stress exerted by the fin against the soil is less than the limits of shear strength and compressive strength of soil so that no slippage will occur.

As discussed, the vibratory squeezing means is composed of a squeezing means, a vibratory means and a damping mechanism. The squeezing means is formed by a shell, and the vibratory means includes an electric motor (13) and eccentrics (14). The motor rotates the eccentrics which produce a circumferential vibration for vibrating the squeezing means. The damping mechanism includes a plurality of sphericals balls (15), a ball bracket (16) to retain the balls, and damping material (17), such as sponge rubber lined about the ball bracket and bearing plate (18). In operation, the bearing plate receives a thrust force from the thrusting means as transmitted through the universal joint of the connection means and transfers the thrust force to the squeezing means. The transfer of force is through rolling balls (15). Because of their rolling action, the balls can attenuate the vibration produced by the vibratory means upon a transfer of thrust to the bearing plate. The balls, thus, serve in the role of a damper. Dowel pins (19) which locate in the pin holes (20) on the tail retaining plate of the squeezing means are carried by bearing plate (19). Damping material (21), such as sponge rubber is located between the dowel pin and dowel hole. The thickness of damping material (17) and (21) should be of a factor larger than the vibration amplitude of the squeezing means. The action of dowel pin (19) and hole (20) prevents bearing plate (18) from undergoing rotary displacement with respect to the squeezing means to insure that sensor (24) delivers precision locating signals.

The subterranean vehicle of the invention begins operation in moving soil with the assist of a booster thruster, an hydraulic jack or the like (not shown in the Figures) so that the spiral fin (10) and rod or pipe (9) may tuck and screw in the soil. Thereafter, the subterranean vehicle" begins a vibratory squeezing action and moves forward under the reaction of the soil against the spiral fin.

Figure 8:
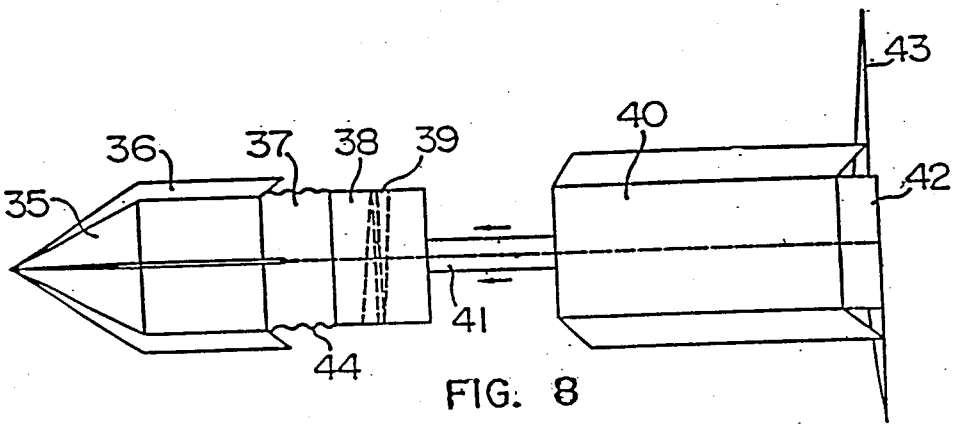
FIG. 8 is a schematic diagram of the hydraulic thrusting type "subterranean vehicle" comprising a second form of the invention.

FIG. 8 illustrates a second embodiment of apparatus defined by an hydraulic thrustor type "subterranean vehicle". The apparatus includes a vibratory squeezing means (35) similar in construction to squeezing means (6) of the first embodiment. A stabilizing guide fin (36) and connection section (37) together with its internal construction are similar to the stabilizing fin or blade (7) and pipe means (8) of the first embodiment, as well. The thruster means is different and two more arresting mechanisms including a front arresting mechanism (38) and front arrester (39), and rear arresting mechanism (42) and rear arrester are added. The thruster means of this embodiment of apparatus is hydraulic, with at least one hydraulic cylinder (40) or a set of evenly arranged hydraulic actuators. The shaft or rod (41) joining the plunger is connected to the front arresting mechanism. This mechanism is fitted with a front arrester in the form of a retractable arrester blade. The rear arresting mechanism (42) is located to the rear of cylinder (40). The rear arrester likewise is in the form of a retractable arrester blades (43) having a large surface area. In operation when the arrester blade in the front retracts and the arrester blade in the rear sticks out, hydraulic shaft (41) acts forward to exert a force on the squeezing means which vibrates and squeezes forward at the same time. At this moment, the hydraulic cylinder of the prime mover (40) is prevented from retracting backward by resistance produced by the rear arrestor blade and the soil. When the opposite situation occurs, that is, when the front arrester blade sticks out and the rear arrester blade retracts in, hydraulic shaft (41) likewise retracts into the hydraulic cylinder. At this moment, the resistance produced by the front arrester blade and the soil prevents the vibratory squeezing means (35) from retreating backward, and the hydraulic actuator moves forward through a distance of one plunger stroke. In this way, one cycle of movements cause the "subterranean vehicle" to move through one stroke distance. The above motion cycle can be programmed and controlled by the microcomputer in connection means (8), (37).

Figure 7:
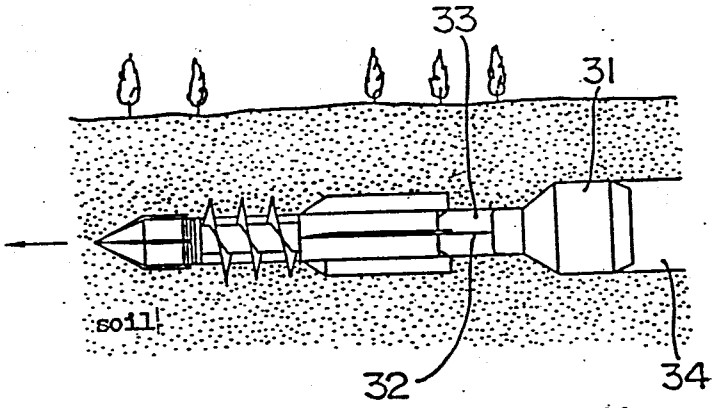
FIG. 7 is a schematic diagram of the "subterranean vehicle" of the first form of the invention in operation.

An alternative embodiment of the invention in a "subterranean vehicle" may be seen in FIG. 7. In this form of the invention an expanding vibratory squeezing section (31) is attached to apparatus as a trailer. The trailer has an internal vibratory means used to expand out a passage, such as passage (33) to a cross section that is other than circular. The expanded passage (34) may be formed to the shape of the trailer, such as horseshoe, elliptical or rectangular shape.

It may be advantageous to locate the expanding vibratory squeezing section at the rear rather than at the front of the apparatus. This is because the vibratory amplitude and frequency of vibration may be implemented at a higher level without limit. Thus, a trailer behind the spiral fin of the thrusting section has no affect in limiting shear strength and compressive strength of soil in contact with the spiral fin. In this way, the squeezing resistance caused by the subterranean vehicle when moving forward may be diminished to a very large extent and the squeezing effect may be increased. The trailer is illustrated connected to the housing of the thrusting device by a connecting cable (32).

Figure 9A:
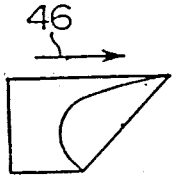
FIG. 9A is a view in side elevation of a wedgeshaped squeezing means.
Figure 9B:
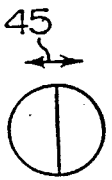
FIG. 9B is a view of the wedgeshaped squeezing means of FIG. 9A, as seen along the lines B—B.
Figure 9C:
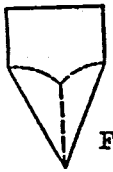
FIG. 9C is a view of the wedgeshaped squeezing means of FIG. 9A, as seen along the lines C—C.

FIGS. 9 (A, B and C) illustrate a squeezing means of wedgeshape outline. In the Figures the direction of vibration of the squeezing means is denoted by the numeral (45), and the direction of motion is denoted by the numeral (46).

As may be appreciated, the apparatus of the invention will permit the production of a subterranean passage or space in soil in substantially any direction of travel. While the invention has been described by reference to specific embodiments, it should be understood and obvious to those skilled in the art that various alterations and modifications of structure may be made without departing from the spirit of the invention as defined by the claims. Thus, the disclosure is for the purpose of illustration, only, and is not intended to limit the invention except as it may be limited by the claims.

What is claimed is:

1. An apparatus for self-propelled movement in soil for forming an underground passage or space comprising (a) head means for reducing resistance of the soil and squeezing the soil in a desired direction;

(b) means supported within said head means for imparting to said head means a controlled multimode vibration;

(c) thrust producing means including (1) thrust spiral means for engaging said soil and in cooperation with said head means develops a forward thrust to advance said apparatus, and (2) a prime mover for rotating said thrust spiral means;

(d) connection means for connecting said thrust producing means and head means.

2. The apparatus of claim 1 further including vibration control means, said vibration control means located at the connection of said thrust producing means and head means to absorb vibration and reduce a force of vibration otherwise acting on said thrust producing means.

3. The apparatus of claim 1 wherein said vibration means comprises at least one eccentric means.

4. The apparatus of claim 1 further including a trailing means for squeezing the soil in the passage or space formed by forward thrust movement of said head means, and means connecting said trailing means and thrust producing means.

5. The apparatus of claim 4 wherein said trailing means acts in squeezing the soil in a geometric cross-section different from the passage or space formed by said head means, said geometric cross-section including cross-sections of horseshoe, elliptical and rectangular shape.

6. The apparatus of claim 1 further including stabilizing means on said head means whereby said head means may undergo said multimode vibration but is prevented from substantially any movement rotationally.

7. The apparatus of claim 1 wherein said thrust spiral means includes a thrust rod and a spiral blade fixed to the outer surface of said thrust rod.

8. The apparatus according to claim 1, wherein said connection means comprises thrust force receiving means for engaging with said thrust producing means, hydraulic means connected between said thrust force receiving means and said head means, and enclosing means for enclosing said thrust receiving means and said hydraulic means.

9. The apparatus according to claim 8, wherein said connection means further comprises control means for controlling said head means, said control means acting on said hydraulic means for controlling frequency, amplitude and direction of said head means and the thrust force of said thrust producing means.

10. The apparatus according to claim 1 which further comprises stabilizing means mounted on the outer surface of said prime mover.

11. The apparatus according to claim 10, wherein said prime mover comprises a electric motor.

12. The apparatus according to claim 8, wherein said thrust producing means comprises hydraulic thrust means including a plunger rod, said plunger rod of said hydraulic thrust means engaged with said thrust receiving means of said connection means, and arresting means for arresting backward movement of said apparatus.

13. The apparatus of claim 12 wherein said arresting means including front arresting means and rear arresting means, said rear arresting means located on said thrust producing means.

14. The apparatus of claim 12 wherein said arresting means comprises retractable arrestor blades.

15. The apparatus according to claim 1, wherein a front part of said head means is substantially cone shape.

16. The apparatus according to claim 1, wherein a front part of said head means is substantially wedge shape.

17. A process using the apparatus of claim 1 for reducing the resistance of soil by vibration, squeezing the soil and advancing said apparatus to form a passage or space in the soil in an underground environment.

18. The process according to claim 17, wherein said process is controlled so that movement of said apparatus in the squeezed soil is in a direction substantially parallel to the ground surface.

19. The apparatus according to claim 3 further including a motor for driving said eccentric means.

20. The apparatus of claim 9 wherein said control means comprises a sensor and microcomputer.

* * * * *